US005564956A

United States Patent [19]

McDavid

[11] Patent Number: 5,564,956

[45] Date of Patent: Oct. 15, 1996

[54] STEERING AND SPEED CONTROL MECHANISM FOR TROLLING MOTORS

[75] Inventor: Charles W. McDavid, P.O. Box 715, Moore Haven, Fla. 33471

[73] Assignee: James Wayne McDavid, Moore Haven, Fla.

[21] Appl. No.: 515,253

[22] Filed: Aug. 15, 1995

[51] Int. Cl.[6] ..... B63H 5/125

[52] U.S. Cl. ..... 440/6; 440/53; 440/87; 74/480 B; 114/146

[58] Field of Search ..... 440/6, 7, 53, 87; 114/146, 144 R, 162; 74/480 B, 543, 544

[56] References Cited

U.S. PATENT DOCUMENTS 4,698,032 10/1987 Hill ..... 440/6

4,735,166 4/1988 Dimalanta ..... 440/6

5,453,030 9/1995 Broussard ..... 440/6

*Primary Examiner*—Jesus D. Sotelo

*Attorney, Agent, or Firm*—William E. Noonan

[57] ABSTRACT

A steering and speed control mechanism is disclosed for a hand-controlled trolling motor. The mechanism includes a yoke assembly having a first section attached to the trolling motor and a second section hingedly attached to the first section. There is a control arm extension, which includes an axially rotatable shaft that carries a handle. A tubular receptacle operably engages the control arm of the trolling motor. A universal joint pivotably interconnects the receptacle and the shaft. A tubular sleeve interconnects the shaft to the second section of the yoke assembly such that the shaft is pivotable and axially rotatable relative to the second section of the yoke assembly. The trolling motor control arm is operated through the control arm extension to control steering and speed of the trolling motor.

16 Claims, 4 Drawing Sheets

STEERING AND SPEED CONTROL MECHANISM FOR TROLLING MOTORS

FIELD OF THE INVENTION

This invention relates to a mechanism for controlling the steering and speed of a trolling motor and, more particularly, to a steering and speed control mechanism that is operably engageable with a standard hand-controlled trolling motor of the type used on fishing boats.

BACKGROUND OF THE INVENTION

Trolling motors are widely used on fishing boats and are most commonly found on boats used to fish inland waters, such as lakes, ponds and marshes. Standard trolling motors employ a motor body or housing having an elongate propeller support that depends from the housing and into the water. Typically, the motor is pivotably mounted to the boat. A control arm extends from the housing into the boat. This arm is utilized to turn the motor and thereby steer the boat. By axially rotating the control arm, the fisherman may also vary the speed of the vessel and in some trolling motors, the arm may be adjusted longitudinally to alternate between forward and rearward speeds. For example, pushing the control arm inwardly toward the housing shifts the motor into a forward gear, whereas pulling the control arm longitudinally outwardly causes the motor to operate in a reverse direction.

Conventional trolling motor control arms are relatively short. Most have a length of only about 5". This provides limited accessibility to the boater and often makes the trolling motor difficult to use, particularly while the boater is fishing. In order to operate the control arm for steering or varying the speed of the vessel, the boater must bend, stoop, or be seated in the boat. Not only is this uncomfortable and awkward, it severely limits the boater's ability to continue fishing while operating the trolling motor. Proper fishing for bass and other fresh water fish often requires the fisherman to be on his or her feet. For example, the fisherman is constantly casting, monitoring his or her line and/or reeling in a fish. These tasks are better performed while standing rather than sitting and are wholly impractical when the fisherman is leaning or stooping to hold the trolling motor control arm.

Extension arms have been provided, which enable the trolling motor to be steered from a standing position. However, to date, none of these known extension arms allows the boater to adjust the speed of the trolling motor or to reverse the direction of the motor while standing.

SUMMARY OF INVENTION

It is therefore an object of this invention to provide a mechanism that permits fisherman and other boaters to comfortably and conveniently steer and control the speed of a trolling motor from either a sitting or a standing position.

It is a further object of this invention to provide a steering and speed control mechanism for a trolling motor, which is quickly and easily adjustable so that it is readily accessible to a boater at various heights and at various positions.

It is a further object of this invention to provide a steering and speed control mechanism that is adaptable for use with a wide variety of standard trolling motors.

It is a further object of this invention to provide a steering and speed control mechanism that allows a fisherman to operate a trolling motor without interrupting his fishing activity.

This invention features a steering and speed control mechanism for a trolling motor. The trolling motor includes a motor housing, an elongate propeller support that depends from the housing and a control arm that extends from the housing transversely to the support. The mechanism of this invention features a yoke assembly including a first section that is attached to the trolling, motor support below the housing and a second section that is hingedly attached to the first section. There is a control arm extension, which includes an axially rotatable shaft and means that define a handle. Means are provided for operably engaging the trolling motor control arm. There are means for pivotally interconnecting the means for engaging with the shaft. Means are provided for mounting the shaft to the second section of the yoke assembly such that the shaft is pivotable and axially rotatable relative to the second section of the yoke assembly. The trolling motor control arm is operated through the control arm extension to control steering and speed of the trolling motor.

In a preferred embodiment the yoke assembly further includes spring means for urging the first and second sections hingedly together. The spring means are responsive to a downward pivoting of the shaft for permitting the first and second sections to be selectively opened relative to one another. The yoke assembly may include friction washer means disposed between the first and second sections for controlling relative movement between those sections.

The control arm extension includes means for adjusting the length of the shaft. The shaft may include a pair of elongate, telescopically interengaged portions. The means for adjusting may include means for releasably interlocking the telescopically interengaged portions. The means for operably engaging may include a receptacle for receiving the control arm and means disposed within the receptacle for operably and releasably gripping the control arm. The receptacle preferably has a generally tubular shape and the means for gripping may include a set screw formed through a side of the receptacle. The means for pivotably interconnecting typically include a universal joint.

The means for mounting may include a tubular sleeve that receives the shaft and permits the shaft to be axially rotated therein. The shaft may be longitudinally slidable in the sleeve. The means for mounting may further include pivot means that interconnect the sleeve to the second section of the yoke assembly. The first section of the yoke assembly may include a clamp for fixedly securing the yoke assembly to the propeller support of the trolling motor.

BRIEF DESCRIPTION OF THE DRAWINGS

Other objects, features and advantages will occur from the following description of preferred embodiments and the accompanying drawings, in which.

DETAILED DESCRIPTION OF PREFERRED EMBODIMENTS

Figure 1:
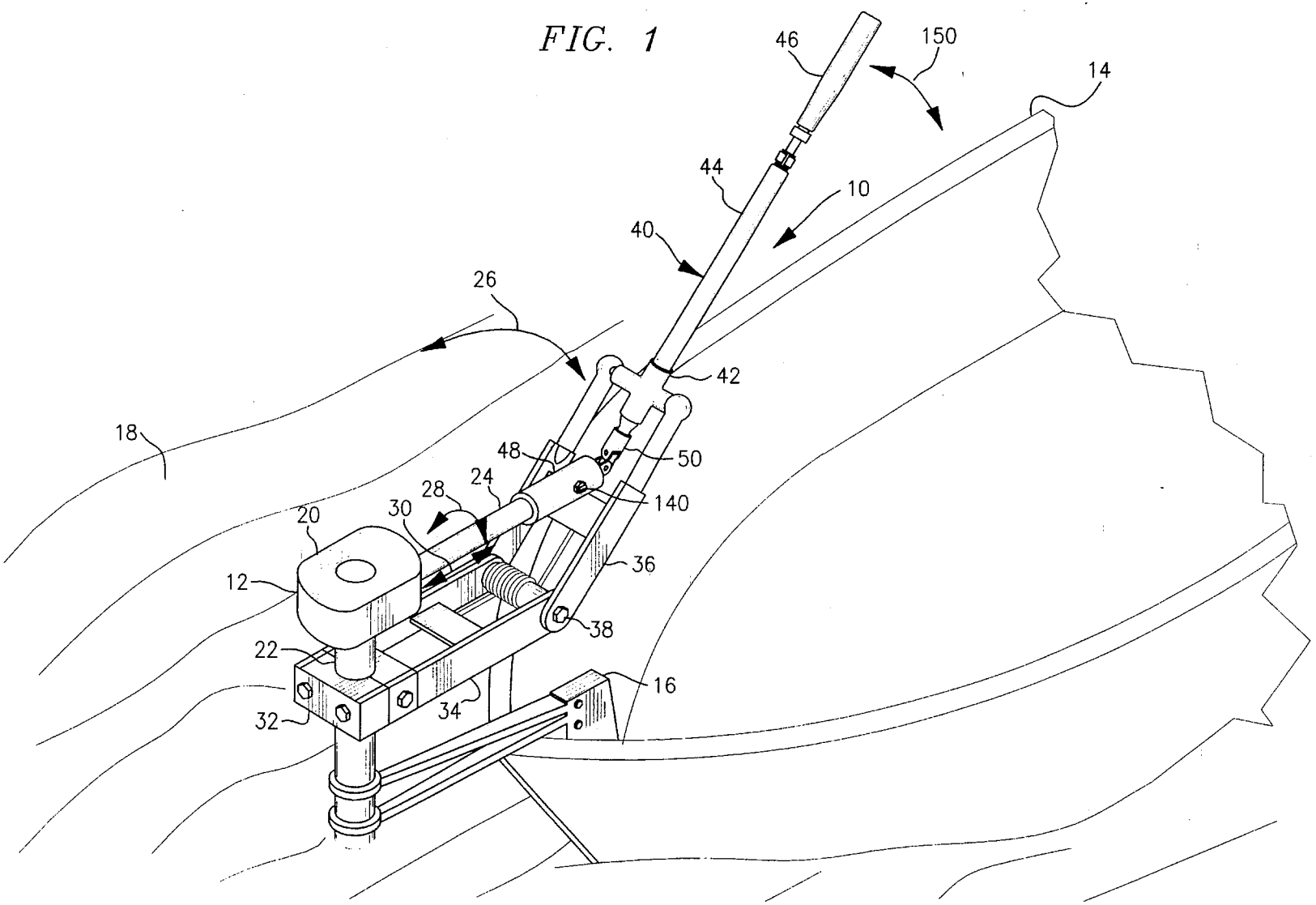
FIG. 1 is a perspective view of the steering and speed control mechanism of this invention operably mounted to the trolling motor of a fishing boat.

There is shown in FIG. 1 a steering and speed control mechanism 10 for a conventional trolling motor 12. The trolling motor may comprise any one of a wide variety of motors commercially available. Trolling motor 12 is secured by a conventional mounting assembly 16 to the bow or stern of a fishing boat 14. The specific details and operation of mounting assembly 16 and boat 14 are well known to those skilled in the art and do not comprise a feature of this invention. Mounting assembly 16 permits trolling motor 12 to be raised out of and lowered into the water 18, as required.

Motor 12 includes a body or housing 20, which encloses the motor. An elongate propeller support 22 depends from body 20. A propeller, not shown, is operably mounted at the lower end of support 22. In FIG. 1, support 22 extends downwardly into water 18. Accordingly, the propeller is disposed in the water to drive the boat when motor 12 is operated. Such operation is controlled by a standard control arm 24 that extends from body 20 transversely to support 22. Conventionally, the fisherman or boater grasps control arm 24 to operate trolling motor 12. By turning arm 24 in either a left-hand or right-hand direction, as indicated by double-headed arrow 26, the fisherman pivots the trolling motor about the longitudinal axis of support 22. As a result, the trolling motor steers boat 14 in a desired direction. Additionally control arm 24 is axially rotated, as indicated by double-headed arrow 28 to adjust the speed of motor 12 and, therefore, the speed of boat 14. In certain trolling motors, control arm 24 is pushed longitudinally inwardly or pulled outwardly as indicated by double-headed arrow 30. This operation is performed to shift motor 12 into either a forward or a rearward direction. Typically, the motor pivots about mounting assembly 16, in a known manner, to raise or lift the motor out of the water such that the propeller is exposed. This operation is not illustrated in FIG. 1, but again, it should be well understood to those skilled in the art.

Because control arm 24 is fairly short and typically has a length of only about 5", it is often awkward and uncomfortable for the boater to operate. Usually, the control arm must be operated from a sitting, squatting or kneeling position. It is virtually impossible for the boater to perform the above-described operations while in a standing position. However, in fishing applications, the boater is standing most of the time.

Figure 2:
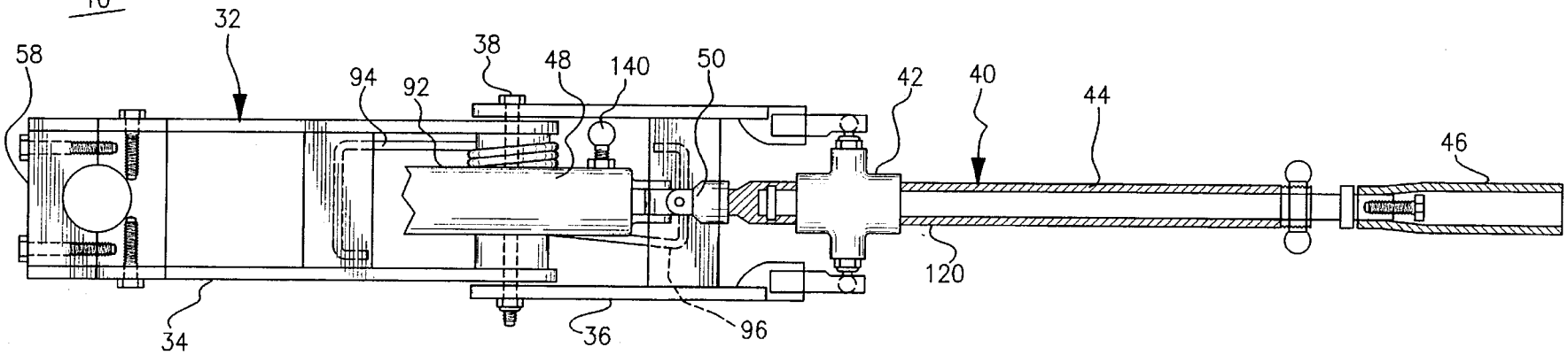
FIG. 2 is a plan view of the steering and speed control mechanism.

Mechanism 10 is adapted for mounting to trolling motor 12 so that improved operation and control of the trolling motor are permitted, even when the boater is standing. Mechanism 10, which is shown fully assembled in FIGS. 1 and 2, includes a yoke assembly 32 that is attached to propeller support 22. More particularly, yoke assembly 32 includes a first section 34 that is attached to support 22 below body 20 and a second section 36 that is hingedly interconnected to section 32 by a pivot pin 38. A control arm extension 40 is both pivotally and axially rotatably mounted to second section 36 of yoke 32 by a tubular sleeve 42. Extension 40 specifically comprises an elongate shaft 44 that is slidably received through sleeve 42. One end of shaft 44 carries a handle 46. The opposite end of the shaft is connected to a generally tubular receptacle 48 through a universal joint 50. As best illustrated in FIG. 1, receptacle 48 receives and operably engages control arm 24 of trolling motor 12.

The components of mechanism 10 are constructed form a rugged and durable, yet relatively light-weight material. Aluminum, light-weight steel and other metals and metal alloys may be employed. High strength plastics and plastic materials may also be utilized.

Figure 4:
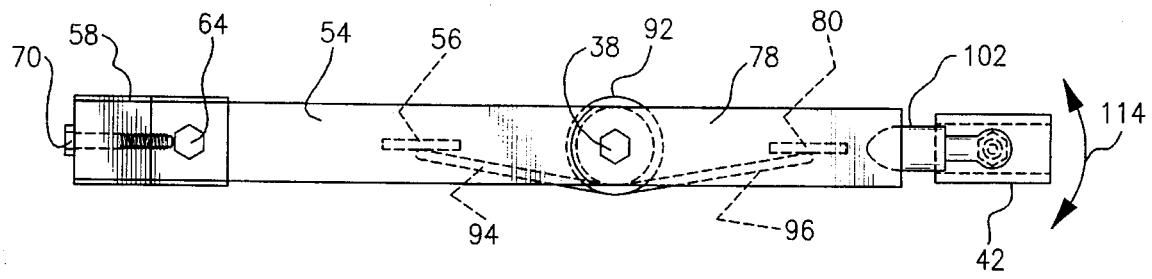
FIG. 4 is a side, elevational side view of the yoke assembly.
Figure 3:
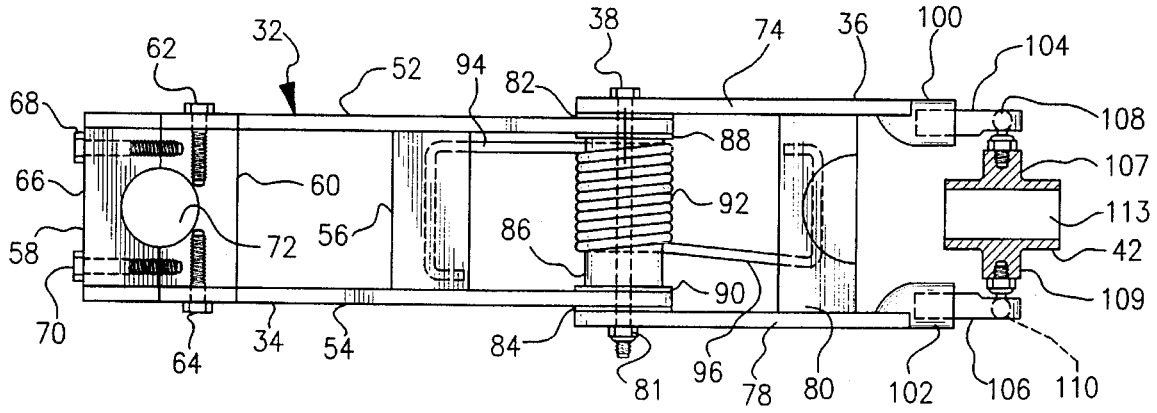
FIG. 3 is a plan view of the yoke assembly alone.

The yoke assembly is shown by itself in FIGS. 3 and 4. First section 34 of yoke assembly 32 includes a pair of generally parallel metal or plastic plates 52 and 54 that are integrally interconnected by a similarly composed cross bar 56. At one end of section 34, a collar 58 fits between plates 52 and 54. Collar 58 includes a first part 60 that is secured to plates 52 and 54 by screws 62 and 64, respectively. The collar also includes a second part 66 that engages part 60. A pair of attachment screws 68 and 70 secure part 66 to part 60. Parts 60 and 66 include respective hemispheric recessed portions along abutting surfaces thereof. When the parts are interconnected to form the collar 58, as shown in FIG. 3, the recessed portions define a circular opening 72. This opening receives support 22 of trolling motor 12 in the manner shown in FIG. 1. To secure yoke assembly 32 to the trolling motor support, bolts 68 and 70 are loosened and part 66 is separated from part 60. The recessed portion of part 60 is then engaged with support 22. Part 66 is re-engaged with part 60 and screws 68 and 70 are reattached to part 60. As a result, collar 58 is securely fastened about support 22.

The opposite end of first section 34 fits between a second pair of parallel plates 74 and 78, which comprise second yoke section 36. Plates 74 and 78 are integrally interconnected by a second cross bar 80. Plates 52, 54, 74 and 78 include respective holes that are aligned proximate the junction of sections 34 and 36 for receiving pivot pin 38. The pivot pin is secured to the interleaved sections 34 and 36 by a nut 81. A friction washer 82 is mounted on pin 38 between plate 74 and plate 52. A similar friction washer 84 is mounted on pin 38 between plates 54 and 78. An elongate bushing 86 and a pair of friction washers 88 and 90 at respective ends thereof are mounted on pin 38 between plates 52 and 54 of first section 34. The friction washers help to control the folding or pivoting movement between sections 34 and 36 of yoke 32 in a manner that will be described more fully below. The spring and the friction washers also serve to provisionally hold mechanism 10 in a selected position without the need for operator intervention.

A helical coil spring, which is formed of any acceptable spring material, is wound about bushing 86 between plates 52 and 54 of first section 34. As depicted in FIGS. 3 and 4, a first end of the spring defines a spring arm 94, which extends from spring 92 and engages the lower surface of cross bar 56. Similarly, the opposite end of the spring defines a spring arm 96, which engages the lower end of cross bar 80 in second section 36. Normally, spring 92 biases hinged sections 34 and 36 into a closed, generally L-shaped condition, as illustrated in FIG. 1. The spring also permits section 34 and 36 to be opened into the generally flat or extended condition illustrated in FIGS. 3 and 4.

The distal ends of second section plates 74 and 78 include respective flanges 100 and 102 that receive and carry respective pivot support elements 104 and 106. Tubular sleeve 42 is pivotally mounted between supports 104 and 106. Specifically, sleeve 42 includes a pair of lateral axle portions 107 and 109 that are threadably engaged by respective pivot elements 108 and 110. Each pivot element includes a spherical head that is received within a complementary recess in a respective one of the pivot supports 104 and 106. As a result, sleeve 42 is mounted such that it pivots relative to yoke section 36 in the manner indicated by double-headed arrow 114 in FIG. 4. Sleeve 42 includes a central tubular opening, 113 that slidably receives shaft 44 of control arm extension 40.

Figure 6:
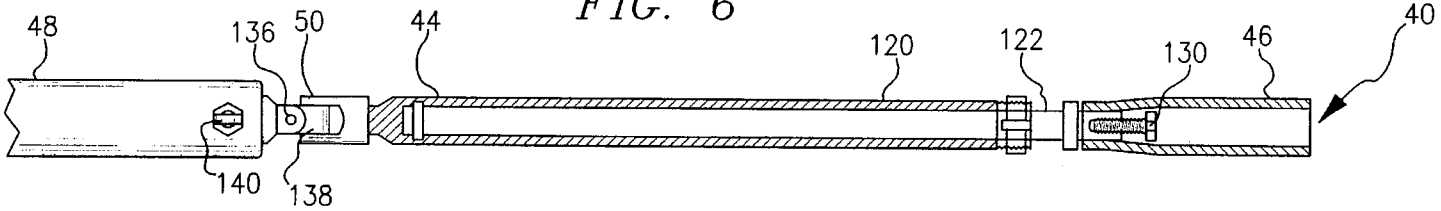
FIG. 6 is an alternative elevational view of the control arm extension taken along the edges of the wing nut and the set screw.
Figure 5:
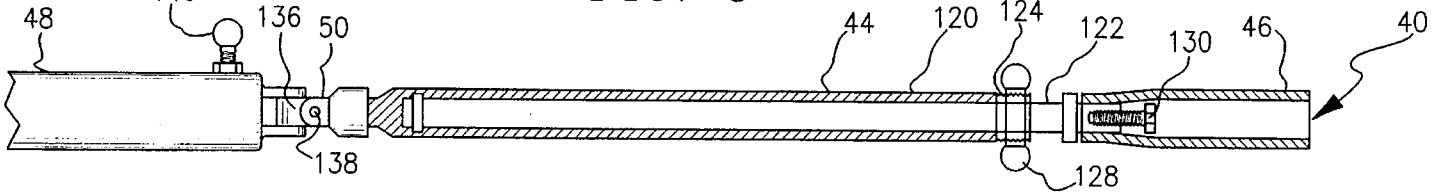
FIG. 5 is an elevational view of the control arm extension viewed from above the wing nut, which adjusts the length of the extension, and the set screw, which secures the extension to the control arm of the trolling motor.

The control arm extension is illustrated by itself in FIGS. 5 and 6. Shaft 44 comprises a pair of tubular elements 120 and 122 that are telescopically interconnected. Inner section 122 slides longitudinally relative to outer section 120. A circumferentially threaded section 124 is formed at the upper end of section 120. A wing nut 128 engages threaded portion 124 to interlock sections 120 and 122 in a fixed position of a desired length. This length is adjusted by loosening wing nut 128 relative to threaded portion 124 and sliding sections 122 relative to one another until a desired length for shaft 44 is achieved. More particularly, the threaded portion 124 is longitudinally split into two or more places. As nut 128 is engaged with threaded portion 124, the threaded portion flexes radially inwardly so that the outer section 122 locks with inner section 120.

Handle 46 is attached to the distal end of tubular section 122 by a bolt 130 disposed within handle 46 and received within the end of the tubular section 122. The head of bolt 130 is sufficiently large to prevent removal of the handle from the shaft. The opposite end of tubular section 120 is interconnected to a tubular receptacle 48 through a universal joint 50. Joint 50 is a conventionally constructed universal joint containing a pair of pivots 136 and 138 that permit pivoting between receptacle 48 and 44. In particular, universal joint 50 permits shaft 44 to transmit axial rotation to receptacle 48 even when the receptacle and the shaft are at an angle and not aligned. The principles of a universal joint are well known and do not comprise a feature of this invention other than in the context of the control mechanism disclosed herein.

A locking screw 140 is formed through a side wall of receptacle 48. When control arm 24, FIG. 1, is received in receptacle 48, screw 140 is tightened such that its inner end bears against the control arm and locks it in place within receptacle 48.

In operation, mechanism 10 is secured to support 22 by engaging collar 58 with the support in the manner previously described. Yoke assembly 32 may be secured at any point along support 22 that achieves smooth and convenient operation of mechanism 10. The precise position along the propeller support may vary depending upon the brand of trolling motor being used. Each fisherman should be able to quickly and conveniently ascertain the most desirable position after some brief testing,. Sections 32 and 34 are then hingedly adjusted so that receptacle 48 can engage control arm 24. The control arm is inserted into receptacle 48 and screw 140 is tightened so that the control arm extension 40 operably engages and grips control arm 24. Mechanism 10 is now ready to be used. As indicated by double-headed arrow 150 in FIG. 1, handle 46 may be pivoted either up or down to raise or lower shaft 44, as required. The spring and washers of assembly 32 hold the shaft and handle in the selected position. When the fisherman is in a standing position, he will typically desire that the control arm extension 40 be in the generally raised position shown in FIG. 1. This enables the boater to operate motor 12 conveniently and comfortably from the standing position.

In particular, motor 12 may be turned left and right, as indicated by double-headed arrow 26, to steer the vessel in a desired direction. Because receptacle 48 of extension 40 is secured to control arm 24 the left-hand and right-hand turning of handle 46 is transmitted through shaft 44, universal joint 50 and receptacle 48 to control arm 24 and thereby to motor 12. To adjust the speed of motor 12 the boater simply axially rotates handle 46. Section 120 of shaft 44 axially rotates within tubular sleeve 42. This axial rotation is transmitted through shaft 44 to universal joint 50. From there, the axial rotation is transmitted to receptacle 48 and to control arm 24. The control arm is rotated, as indicated by double-headed arrow 28, until it reaches the desired speed position. Motor 12 may also be alternated between forward and reverse positions by using mechanism 10. When handle 46 is longitudinally pulled by the standing fisherman, this movement is transmitted through extension 40 to control arm 24. Conversely, the direction of the vessel is reversed when the handle is longitudinally pushed. During the pulling and pushing motion, the shaft 44 slides longitudinally through sleeve 42. The hinged yoke assembly flexes to permit smooth and controlled movement of the control arm extension. The friction washers 82, 84, 88 and 90 counteract the coil spring to permit such movement.

Figure 7:
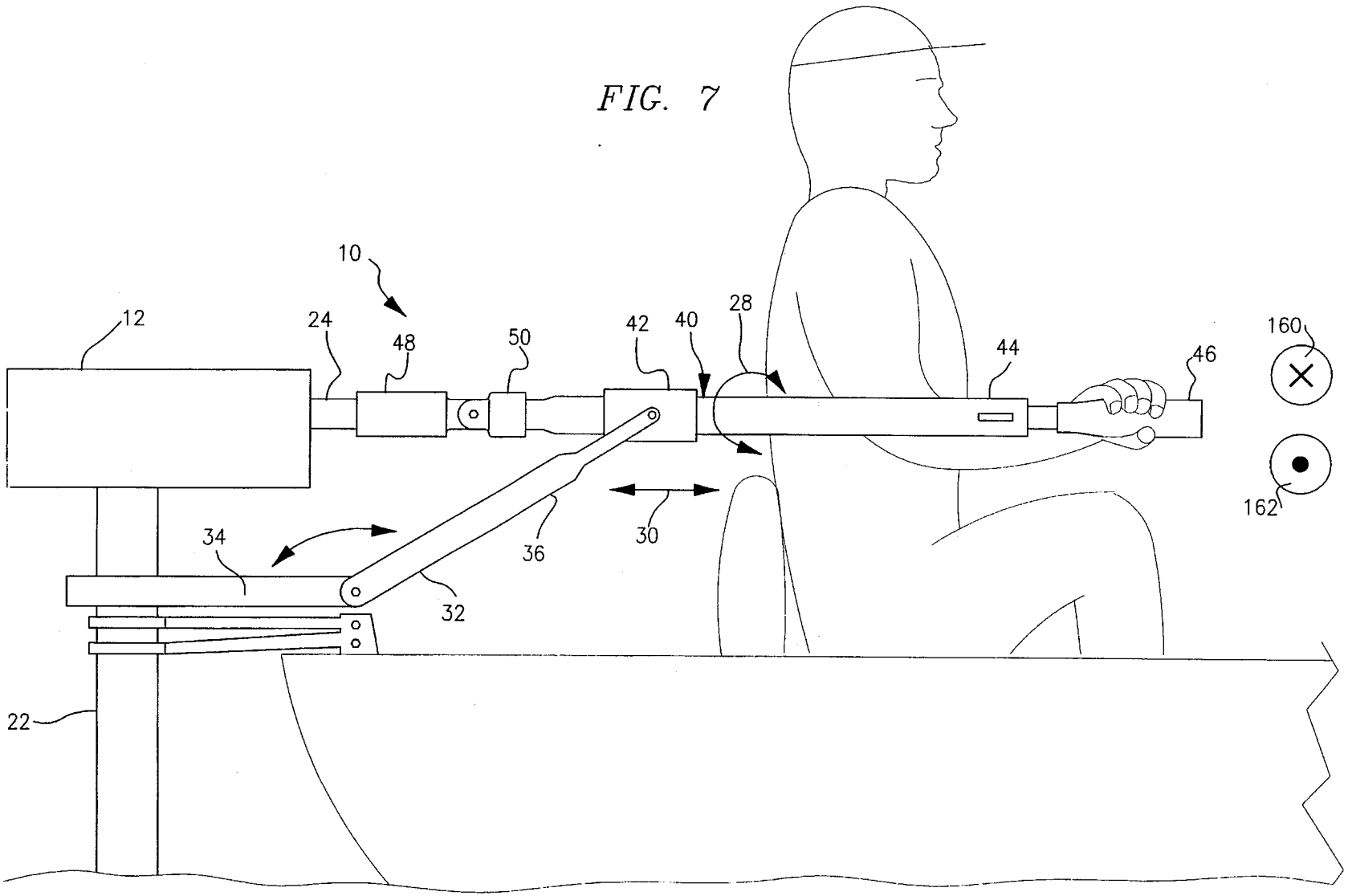
FIG. 7 is an elevational view of the steering and speed control assembly mounted to a trolling motor, with the control arm extension in a generally horizontal orientation to control operation of the motor when the fisherman is seated in the boat.

At times, the boater may desire to operate mechanism 10 from a sitting or kneeling position. The mechanism is shifted for such operation by pivotally lowering handle 46 in the downward direction of doubleheaded arrow 150. As illustrated in FIG. 7, handle 46 is lowered such that shaft 44 maintains a generally horizontal orientation. As handle 46 pivots downwardly, tubular sleeve 42 pivots relative to second section 36 of yoke assembly 32 and universal joint 50 pivots into a more aligned and less L-shaped condition. Additionally, sections 34 and 36 of yoke assembly 32 open somewhat from the condition shown in FIG. 1 to that shown in FIG. 7. The spring tension provided by spring 92 resists the opening of the hinged yoke sections somewhat so that a smooth, controlled movement is exhibited as the handle and control arm extension are lowered.

In the lowered condition, shown in FIG. 7, mechanism 10 is used by a seated or kneeling boater, in a manner similar to that described above, to control operation of trolling, motor 12. Specifically, the motor is turned to steer the boat by moving handle 46 in the left-hand and right hand directions of arrows 160 and 162, respectively. The speed of the trolling motor is adjusted by turning handle 46 such that shaft 44 axially rotates in the manner indicated by double-headed arrow 28. Changing the motor from a forward to a reverse direction and vice versa is accomplished by simply pushing and pulling the handle inwardly and outwardly, as indicated by double-headed arrow 30. The shaft slides through or rotates within sleeve 42, as required. Again, all of these movements are transmitted through the universal joint 50 and the receptacle 48 that is attached to standard control arm 24.

When the boater or fisherman desires to resume a standing position, the handle 46 and shaft 44 are simply raised from the position shown in FIG. 7 to the position shown in FIG. 1 (or to any desired intermediate position). The spring 92 urges section 36 of yoke assembly 32 into the more vertical orientation shown in FIG. 1. Friction washers 82, 84, 86 and 88, FIG. 3, resist the upward bias of the coil spring so that smooth, controlled movement of the handle and shaft are exhibited. Raising and Lowering the control arm extension does not require any great tugging, pulling or inordinate amount of force. Sudden or jerking movements are avoided. Rather, a very smooth and yet controlled movement is provided. As a result, mechanism 10 is easy to handle for persons of virtually all ages and physical capabilities. The spring and friction washers of the yoke assembly also hold the control arm extension at any desired angle regardless of whether or not the boater is grasping the handle. In other words, the mechanism does not collapse when the boater releases the handle. Therefore, the present invention permits boaters and fishermen to conveniently control the speed, direction and other functions of a trolling motor from either a seated or a standing position within the boat. Comfort is improved and fishing is made much more pleasurable.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A steering and speed control mechanism for a trolling motor, which motor includes a motor housing, an elongate, propeller support that depends from the housing and a control arm that extends from the housing transversely to the support, said mechanism comprising:

a yoke assembly including a first section that is attached to the trolling motor support below the housing and a second section that is hingedly attached to said first section;

a control arm extension, which includes an axially rotatable shaft, a handle carried by said shaft, means for operably engaging the trolling motor control arm, and means for pivotably interconnecting said means for engaging with said shaft, and means for mounting said shaft to said second section of said yoke assembly such that said shaft is pivotable and axially rotatable relative to said second section of said yoke assembly, whereby the trolling motor control arm is operated through said control arm extension to control steering and speed of the trolling motor.

2. The mechanism of claim 1 in which said yoke assembly further includes spring means for urging said first and second sections hingedly together and being responsive to a downward pivoting of said shaft for permitting said first and second sections to be selectively opened relative to one another.

3. The mechanism of claim 1 in which said control arm extension includes means for adjusting the length of said shaft.

4. The mechanism of claim 3 in which said shaft includes a pair of elongate, telescopically interengaged portions.

5. The mechanism of claim 4 in which said means for adjusting include means for releasably interlocking said telescopically interengaged portions.

6. The mechanism of claim 1 in which said means for operably engaging include a receptacle for receiving the control arm and means within said receptacle for operably and releasably gripping the control arm.

7. The mechanism of claim 6 in which said receptacle has a generally tubular shape and in which said means for interengaging include a set screw formed through a side of said receptacle.

8. The mechanism of claim 1 in which said means for pivotably interconnecting include a universal joint.

9. The mechanism of claim 1 in which said means for mounting include a tubular sleeve that receives said shaft and permits said shaft to be axially rotated therein.

10. The mechanism of claim 9 in which said shaft is longitudinally slidable in said sleeve.

11. The mechanism of claim 9 in which said means for mounting further include pivot means that interconnect said sleeve to said second section of said yoke assembly.

12. The mechanism of claim 1 in which said first section of said yoke assembly includes a clamp for fixedly securing said yoke assembly to the propeller support of the trolling motor.

13. The mechanism of claim 1 in which said yoke assembly includes friction washer means disposed between said first and second sections for controlling selective movement between said first and second sections.

14. A steering and speed control mechanism for a trolling motor, which motor includes a control arm that is pivoted to control direction of the vessel and axially rotated to control the speed of the vessel, said mechanism comprising:

a yoke assembly including a first section that is attached to the trolling motor and a second section that is hingedly attached to the first section;

a control arm extension, which includes an axially rotatable shaft, a handle carried by said shaft, means for operably engaging the trolling motor control arm, and means for pivotally interconnecting said means for engaging with said shaft, and means for mounting said shaft to said second section of said yoke assembly such that said shaft is pivotable and axially rotatable relative to said second section of said yoke assembly, whereby the trolling motor control arm is operated through said control arm extension to control steering and speed of the trolling motor.

15. The mechanism of claim 14 in which said yoke assembly further includes spring means for interconnecting said first and second sections and controlling relative movement between said first and second sections.

16. The mechanism of claim 15 in which said yoke assembly further includes friction washer means for counteracting said spring means and further controlling relative movement between said first and second sections.

* * * * *